US012673750B2

(12) United States Patent
Van Blaaderen

(10) Patent No.: US 12,673,750 B2
(45) Date of Patent: Jul. 7, 2026

(54) ECCENTRIC SUCTION PILE PUMP WITH HINGED LIFT APPLIANCE

(71) Applicant: SPT Equipment B.V., Woerden (NL)

(72) Inventor: Engel Albert Van Blaaderen, Woerden (NL)

(73) Assignee: SPT Equipment B.V., Woerden (NL)

( * ) Notice: Subject to any disclaimer, the term of this patent is extended or adjusted under 35 U.S.C. 154(b) by 258 days.

(21) Appl. No.: 17/766,334

(22) PCT Filed: Oct. 2, 2020

(86) PCT No.: PCT/NL2020/050613
§ 371 (c)(1),
(2) Date: Apr. 4, 2022

(87) PCT Pub. No.: WO2021/066656
PCT Pub. Date: Apr. 8, 2021

(65) Prior Publication Data
US 2023/0071305 A1 Mar. 9, 2023

(30) Foreign Application Priority Data
Oct. 2, 2019 (NL) ..... 2023942

(51) Int. Cl.
*B63B 21/29* (2006.01)
*B63B 21/27* (2006.01)
(Continued)

(52) U.S. Cl.
CPC ..... *B63B 21/27* (2013.01); *E02D 27/525* (2013.01); *E02B 2017/0043* (2013.01);
(Continued)

(58) Field of Classification Search
CPC ..... B63B 21/27; E02D 27/525; E02D 2250/0053; E02B 2017/0078;
(Continued)

(56) References Cited

U.S. PATENT DOCUMENTS 6,009,825 A 1/2000 Fulton et al.
6,360,682 B1 * 3/2002 Riemers ..... B63B 21/27 114/296
(Continued)

FOREIGN PATENT DOCUMENTS

EP 0011894 A1 11/1980
EP 0011894 B1 7/1984
(Continued)

OTHER PUBLICATIONS

International Searching Authority; International Search Report for International PCT application PCT/NL2020/050613; mailing date Jan. 28, 2021; 4 pages.
(Continued)

*Primary Examiner* — Edwin J Toledo-Duran
(74) *Attorney, Agent, or Firm* — McDonnell Boehnen Hulbert & Berghoff LLP

(57) ABSTRACT

Assembly of a suction pile and a pump system temporary connected by convenient means to the suction space of the suction pile, wherein the pump system bears onto the top of the upward extending suction pile. Between suction pile and pump system a quick connector is operative comprising a pin operated by actuator means of the pump system to move between a releasing retracted and locking extended position. It has one or more of: a pump interface remote from the protective frame; an auxiliary support frame; a hinged lift appliance; a level indicator; a docking cone designed to penetrate the suction pile interface means.

26 Claims, 13 Drawing Sheets

(51) Int. Cl.
*E02D 27/52* (2006.01)
*E02B 17/00* (2006.01)

(52) U.S. Cl.
CPC ..... *E02B 2017/0078* (2013.01); *E02B 2017/0091* (2013.01); *E02D 2250/0053* (2013.01)

(58) Field of Classification Search
CPC ..... E02B 2017/0091; E02B 21/29; Y02E 10/727; Y02E 10/72
See application file for complete search history.

(56) References Cited

U.S. PATENT DOCUMENTS 6,719,496 B1 * 4/2004 Von Eberstein ..... B63B 21/22 114/296
6,910,831 B2 * 6/2005 Raines ..... B63B 21/29 405/224.1
8,215,873 B1 * 7/2012 Lugo ..... E02D 5/80 405/251
8,882,392 B1 * 11/2014 Cruz ..... E02D 5/223 405/172
9,359,852 B2 * 6/2016 Kebadze ..... E21B 41/0007
9,868,492 B1 * 1/2018 Mohrfeld ..... E02D 7/20
9,869,071 B1 * 1/2018 Mohrfeld ..... E02D 7/06
2002/0122696 A1 * 9/2002 Sokol ..... E02D 13/00 405/232
2003/0167659 A1 * 9/2003 Raines ..... B63B 21/27 37/345
2005/0201835 A1 9/2005 Alliot
2006/0065180 A1 * 3/2006 Raines ..... B63B 21/27 114/295
2006/0127187 A1 * 6/2006 Raines ..... B63B 21/27 405/226
2007/0140796 A1 * 6/2007 Alhayari ..... B63B 21/27 405/224.1
2008/0286050 A1 * 11/2008 DeLack ..... E21B 43/013 405/172
2009/0100724 A1 * 4/2009 McCoy, Jr. ..... E02F 3/9243 37/317
2009/0232605 A1 * 9/2009 Breivik ..... E21B 19/002 405/203
2010/0021241 A1 * 1/2010 Thomas ..... B63B 21/27 405/224.1
2011/0139054 A1 * 6/2011 Liu ..... B63B 21/00 114/230.14
2012/0024535 A1 * 2/2012 Lieske, II ..... E21B 43/0122 166/363
2012/0266801 A1 * 10/2012 Brinkmann ..... B63B 35/08 405/224
2012/0285362 A1 * 11/2012 Evans ..... B63B 21/27 114/296
2015/0191220 A1 * 7/2015 Mohrfield ..... B63B 21/27 29/434
2016/0090709 A1 * 3/2016 Mohrfeld ..... E02D 31/10 49/404
2017/0130547 A1 * 5/2017 Bhatnagar ..... E21B 17/02
2018/0171573 A1 * 6/2018 Krstulovic-Opara ... B63B 1/041
2019/0078287 A1 * 3/2019 Olsen ..... E02D 7/20
2019/0137005 A1 * 5/2019 Endal ..... E21B 43/0107
2019/0162038 A1 * 5/2019 Reinås ..... E21B 33/035
2019/0315438 A1 * 10/2019 Prasad ..... B63B 39/06
2020/0040541 A1 * 2/2020 Van Der Tempel .. E04H 12/085
2020/0071899 A1 * 3/2020 Dingman ..... F16L 55/1125
2020/0071904 A1 * 3/2020 Safaqah ..... E02D 27/50
2024/0191453 A1 * 6/2024 Haun ..... F16L 1/16
2025/0230621 A1 * 7/2025 Olsen ..... E02D 15/08

FOREIGN PATENT DOCUMENTS

EP 1101872 A2 5/2001
EP 3315670 A2 * 5/2018 ..... E02D 27/525
GB 2300661 B 11/1986
NL 8101640 A 11/1982
WO 9951821 10/1999
WO 02/088475 A1 11/2002
WO 2007/063130 A2 6/2007
WO 2018117859 A1 6/2018

OTHER PUBLICATIONS

International Searching Authority; Written Opinion of the International Searching Authority for International PCT application PCT/NL2020/050613; mailing date Jan. 28, 2021; 7 pages.

* cited by examiner

ECCENTRIC SUCTION PILE PUMP WITH HINGED LIFT APPLIANCE

BACKGROUND

This description relates to a suction pile pump device for use during installing or removing a foundation system for an offshore payload, e.g. an offshore wind energy installation or for oil or gas applications. The foundation system is provided with one or more suction buckets (hereafter also called "bucket" or "suction pile" or "pile"). In case of a wind energy installation the mast preferably comprises an upright monopole and on top of it (e.g. at the so called transition piece) an upright tower, wherein the tower supports the nacelle, carrying the blades, at its top. Instead of a nacelle the payload could comprise e.g. a platform, e.g. for oil or gas application or a transformer platform for an offshore substation. The foundation comprises e.g. a jacket or a cluster pile. Sea depth typically will be at least 10 or 20 or 50 or 60 met res and feasible is at least 500 or 1000 meters, e.g. 3000 met res. The foundation system can also provide an anchoring system, e.g. for mooring purposes, e.g. a floating offshore wind energy installation or different floating object.

Orientations, e.g. "up", "down", "top", "aside", "upright", "vertical", "above", "level" are in this document related to the situation that the pump system is in its operative position and operatively coupled with the bucket and fluid pump running, actively sucking fluid from the pressure space, while the bucket is oriented vertically upright, top bulkhead above and open underside below, longitudinal axis vertical.

Suction buckets and how to install them are a.o. known from GB-B-2300661 and EP-B-0011894, which are enclosed in here by reference. A suction bucket is a thin walled steel or reinforced mineral cement concrete sleeve or pipe or cylinder, which is closed at its longitudinal top end by a bulkhead (also called top plate) or different sealing means of steel or reinforced mineral cement concrete and which is sealingly located on the subsea bottom with the open end opposite the bulkhead since this open end penetrates the subsea bottom due to the weight of the suction bucket. Thus the cavity, also called suction space, delimited by the cylinder and the bulkhead is sealed by the subsea floor such that vacuum or suction can be generated by removing water from within the suction space such that a resulting force tends to force the suction bucket deeper into the subsea floor. The creation of the suction is by a suction source, such as a fluid pump, being on, or close to or at a distance from the suction bucket and connected to the suction space. The fluid pump is preferably designed to pump liquid, e.g. water.

A self installing marine structure, e.g. platform applying suction buckets is known from e.g. WO99/51821 or EP-A-1 101 872. WO 02/088.475 discloses a tower carrying a wind turbine at the top and suction buckets as foundation.

Suction buckets are applied as (part of) a foundation of an offshore wind energy turbine. For such application, typically a single or three or more mutually spaced suction buckets are applied, providing a static balanced or overbalanced support. In operation, the suction buckets have at least almost completely penetrated the sea bed, are at equal or substantially equal level and are adjacent each other or have a mutual horizontal spacing providing a clearance of at least 5 metre, typically in the order of 20 metre or more, e.g. between 30 and 35 metres, or a clearance of at least 0.5 or 1.0 times the diameter of the suction bucket (clearance means the shortest distance between the facing side walls). This single bucket or assembly of suction buckets carries a single monopole or a space frame (i.e. jacket) of steel beams or tubes and on top of it a vertical tower supporting at its upper end the nacelle of the wind energy turbine provided with rotor blades, typically rotating around a horizontal axis and driven by the wind. The wind energy turbine converts wind energy into electrical energy. The wind turbine is typically part of a wind farm of identical wind turbines each provided with its own foundation of three or more suction buckets. A cable brings the electricity from the wind turbine generator to an electricity consumer onshore, e.g. a household.

The complete offshore structure is typically at least substantially made from metal, typically steel.

Preferably each suction bucket has one or more of: a diameter of at least 5 metres, typically between 7 or 10 and 15 metre or even more; a height of at least 5 metres, typically between 10 and 15 metre or even more and/or less than 20 or 30 metre, subject to the soil conditions; a wall thickness of at least 1 centimetre, typically at least 3 or 5 centimetre and/or below 10 or 15 or 20 centimetre; the longitudinal axis of the suction bucket and the relevant supporting leg (of the upper structure to be supported by the suction bucket) are substantially in line or eccentric.

A prior art pump system is diclosed in EP17166678.7

OVERVIEW

By way of example, an aspect of the disclosure is one or more of: simple design of the suction pile, in particular its top bulkhead is facilitated; storage and/or transport of one or more pump systems is facilitated; ease of handling, e.g. upending, is facilitated. Aspects can also be learned from the information disclosed in the application documents.

For offshore installations, particularly for wind energy turbines, there are stringent requirements on many topics. Examples of these topics are: low production costs; fast and efficient installation in a matter of 1-8 hours; environmental friendly.

Another aspect is obtained by a pump system designed to be temporary connected to the internal space (also called suction space) of the suction pile to generate an over pressure or under pressure within the suction space, preferably wherein the pressure difference generated relative to the surrounding water pressure (e.g. approximately 10 bar at 100 meter water depth or 100 bar at 1000 meter water depth) is at least 0.5 or 1 or 2 or 3 or 5 bar. Preferably the pump system is designed to generate within the suction space an over or under pressure between 5 and 10 bar. It will be appreciated that for the under pressure (i.e., the suction), lowering of the pressure within the suction space is limited by the vacuum level (0 bar) such that at a pressure of e.g., 3 bar of the surrounding water (at a water depth of approximately 20 meter), a pump system rated for 5 bar pressure difference shall be unable to lower the pressure for more than 3 bar within the suction space (in practice the maximum attainable under pressure level will be a fraction of 1 bar above vacuum, e.g., 0.1 or 0.05 bar).

One or more of the following preferably applies to the pump system (any one of the mentioned parts preferably permanently mounted to the pump system): designed to stably bear onto the suction pile top bulkhead, e.g. by comprising at least three mutually spaced supporting feet; a main frame, to carry all parts of the pump system; a three dimensional enclosure, e.g. a space frame of, preferably straight, beams, as an external protecting shell or envelope (also called "protective frame") for the fluid pumps, e.g. of rectangular and/or elongate shape, wherein the one or more fluid pumps are enclosed within the space delimited by the protective frame; at least one or two, electrically or hydraulically driven, fluid pumps, e.g. one or more of centrifugal type, fixed displacement type (e.g. "lobe pump"), positive displacement type (e.g. membrane or piston type); at least two fluid pumps of different or identical type; a fluid pump of high flow low pressure type, e.g. centrifugal fluid pump; a fluid pump of low flow high pressure type, e.g. membrane pump or piston pump or positive displacement pump; an interface means, e.g. provided by or comprising a from the lower side of the pump system downward projecting tube stud, providing the pump system interface to connect the fluid pump to the suction space for fluid communication, which interface means preferably is provided with a seat, e.g. a flange, at its end remote from the pump system, against which the corresponding interface means at the suction pile, e.g. provided by or comprising an upward directed pipe stud, becomes seated, e.g. a corresponding seat, e.g. a flange; the interface means provided with a seal for sealing engagement to the suction pile interface means; the interface means designed such that, if the interface means of the pump system and the suction pile are fluidly connected, the pump is fluidly connected to the suction space through a fluid line connected to both the pump and to the pump system interface means; the pump system, preferably at or adjacent and/or at opposite sides of the interface means, provided with a connector member for releasable locking engagement with a corresponding connector member at the bucket, e.g. provided at the bucket top bulkhead, e.g. at the corresponding interface means of the bucket or adjacent and/or at opposite sides of the bucket interface means; the connector member comprising a quick connector with preferably padlock eye system for engagement with a corresponding quick connector at the bucket; the interface means designed for spring loaded seated connection to the bucket interface means; a measurement probe, e.g. echo sounder probe, designed for measurement through top bulkhead tube stud of bucket; docking cone designed to penetrate top bulkhead tube stud to align pump system for sufficient sealing; piping provided with one or more, e.g. two, 3way valves for changing the water flow direction provided by a fluid pump, e.g. centrifugal pump, from suction to pressing without the need to reverse the fluid pump; pin override system on latching pins; valve arrangement for reversing pump flow; vent valve arrangement in pump system (e.g. straight above or integrated in or associated with the interface means); system to temporarily increase venting capacity; convenient position of its centre of gravity, preferably approximately in the centre of the pump system, e.g. one or more of lengthwise, widthwise and heightwise; lift and/or upend appliance; a control panel, e.g. having a width and/or height at least 25 or 50 centimetre, connected and designed to be operated by a ROV such that the ROV can operate and monitor the pump system and provided with input and output means adapted for the ROV, e.g. input means such as one or more actuators, e.g. one or two or more mechanical switches and/or mechanical levers, e.g. to open or close a valve or different operating means of the pump system, designed to be operated by an actuating means, e.g. robot arm, of the ROV and/or output means such as one or two or more display devices, e.g. gauges or an electronic display screen, designed to be monitored by a camera of the ROV to e.g. capture a pressure or temperature or different data of the pump system; the control panel being fastened to and/or carried by the protective frame and/or the first area.

Operation of a pump system can be made easier based on aspects of this description.

The cited documents are inserted in here by reference and each provide technical background for a better understanding of this description.

Preferably one or more of the following applies: the suction required to penetrate the suction bucket into the subsea bottom during installation is generated above the top bulkhead of the suction bucket, preferably since the suction side of a suction pump means or the pressure side of a pressure pump means is connected to the suction bucket at a location above the top bulkhead, e.g. the top bulkhead is provided with a nozzle or different sealable port for fluid connection of the suction space with a separate suction or pressure pump means; the diameter of the suction bucket is constant over its height (the height is the direction from the top bulkhead towards the opposite open end); from the top bulkhead the cylinder walls of the suction bucket extend parallel; the open end of the suction bucket, designed to be located on the sea floor first is completely open, in other words, its aperture is merely bordered by the cylinder walls; the water depth is such that the suction bucket is completely below the water surface when its lower end contacts the sea floor, in other words when its lower end has not penetrated the sea floor yet; the foundation comprises three, four or more mutually spaced suction buckets; the by releasable sealing means, e.g. a valve, selectively closable port in the top bulkhead to allow water entering and/or exiting the suction bucket is provided with a coupling means designed for temporary engagement of a suction and/or pressure pump at the time of installing, settlement correction and removing, respectively, of the suction bucket into and from, respectively, the seafloor soil, which port is associated with the fluid flow channel.

Preferably, the design of the suction bucket is such that fluid from a source, e.g. pressure pump, flows from the source through a sealed channel, terminating below the bulkhead and within the suction space. During sucking in the pressure is typically at least 0.1 or 0.25 or 0.5 or 1 bars below the local water pressure external from the suction bucket. During pressing out (correction operation or decommissioning) the pressure is typically at least 0.25 or 0.5 or 1 or 2 bars above the local water pressure external from the suction bucket.

The suction bucket is also preferably provided with known as such valves and/or hatches adjacent or at its top bulkhead for selectively allowing water and air to enter or exit the suction space through the top side of the suction bucket.

The pump system interface means and the suction pile interface means preferably have, in the operational position during suction or pressing, a longitudinal axis parallel to the one of the suction pile.

The top bulkhead of the suction pile is provided with an interface means, e.g. upward projecting tube stud, providing the suction pile interface to connect the fluid pump to the suction space. Preferably this means is provided with one or more of: a valve to selectively seal the suction space; a seat, e.g. a flange, at its end remote from the top bulkhead, onto which the corresponding interface means at the pump system, e.g. downward directed pipe stud, becomes seated, e.g. a corresponding seat, e.g. a flange; a coupling member for releasable and/or temporary engagement with the corresponding member at the pump system interface, e.g. a padlock eye system, preferably oriented for penetration in a direction perpendicular to the suction pile longitudinal axis. The padlock eye system preferably comprises a retractable pin, preferably provided with a drive means to extend and retract, and/or at least one plate or structural element, mutually spaced and/or parallel, each having a hole, aligned mutually and with the pin. Preferably the plate or element extends parallel to the interface longitudinal axis and/or the hole is oriented for inserting a pin perpendicular to the suction pile longitudinal axis. The coupling member could also be provided at another location at the bucket, e.g. adjacent and/or at opposite sides of the interface means.

The description describes a pump system to be operatively connected temporary to a suction pile as a marine structure or part of it, the suction pile preferably provided by an open bottom and closed top, advantageously cylindrical, elongate shell providing a suction compartment or suction space, said closed top having an externally facing upper face and an opposite, toward the suction space facing lower face and preferably provided with one or more valves selectively allowing fluid communication between the suction space and the environment.

To the lift and/or upend appliance, preferably one or more of the following applies: designed to lift or move the complete pump system, e.g. by acting on the main frame and/or protective frame; designed such that if the pump system is attached to the suction pile and is lifted by a hoisting means (e.g. crane hook of a crane) attached to the main frame and/or protective frame, the suction pile suspends from the lift appliance; having means for coupling of the pump system to the top bulkhead while simultaneously it is preferably allowed that the suction pile interface means and the pump system interface means can switch between two states such that they are selectively mutually spaced (e.g. for venting capacity, e.g. increased) or mutually connected; a from the pump system separate connector means or frame is provided with an element of the pump system coupling system and is attached to the pump system, e.g. main frame and/or protective frame by at least one movement means, preferably linear actuator, e.g. hydraulic jack, preferably regularly spaced around the pump system interface means; the element of the pump system coupling system is adapted for, preferably releasable, engagement with an element of the suction pile coupling system; while the elements of the pump system coupling system and the suction pile coupling system are mutually engaged, the distance between the pump system and the suction pile can be adapted by operating the linear actuator to extend or retract; this mutual movement of the pump system interface means and the suction pile interface means is a linear or a tilting movement, in which latter case the connector means is preferably pivoted to the pump system. In this manner de flow through area is e.g. enlarged from 20 inch to 28 inch diameter, for venting.

To the quick connector to the top bulkhead tube stud, preferably one or more of the following applies: with means for releasable locking to the suction pile interface means; with preferably a hole and/or pin, the pin preferably operated by actuator means of the pump system to move between a releasing retracted and locking extended position, preferably by lengthwise movement and/or movement perpendicular to the interface means longitudinal axis; a padlock eye system; a spring loaded seated connection, e.g. a longitudinally resilient tube stud, preferably providing the tube free end (viz. e.g. FIG. 13). The padlock eye system preferably comprises (viz. e.g. FIG. 14-16) one or two spaced parallel plates or structural elements each having a mutually registered hole, the plates or elements preferably projecting from the pump system interface means and the coupling with the suction pile is made by locating a hole in a plate or structural element of the suction pile interface means in register with the pump system interface means and inserting a tightly fitting pin into these two or three holes. The plates or elements preferably extend parallel to the interface means longitudinal axis.

To the docking cone preferably one or more of the following applies: designed to penetrate the suction pile interface means, e.g. top bulkhead tube stud to align the pump system, or part of it, for sufficient sealing coupling of both interface means; projects downwards and/or below the pump system; is provided by a spatial arrangement of plate like members to provide maximum flow through passage, e.g. at right angle crossing plates oriented parallel to and the cross axis co axial with the interface longitudinal axis (viz. e.g. FIG. 8); co axial with pump system interface means.

Preferably, another aspect is obtained by one or more of: a pump interface remote from the protective frame; an auxiliary support frame; a hinged lift appliance; a level indicator.

Pump Interface Remote from Protective Frame

The pump system preferably has the pump interface means, permanently mounted to the main frame, located externally from and/or at a distance to, preferably aside from, the protective frame and/or the one or more fluid pumps, e.g. for a distance of at least 25 or 50 centimetre, preferably located at the lower side or bottom of the pump system. This allows for e.g. more design flexibility.

Auxiliary Support Frame

The main frame preferably comprises an auxiliary support frame located externally from and/or remote from the one or more fluid pumps and/or the protective frame, e.g. for a distance of at least 10 or 25 or 50 centimetre. Preferably one or more of the following applies to the auxiliary support frame: is laterally projecting from the protective frame, preferably from the lower side; is located at the lower side or bottom of the pump system; has one or more of the pump interface means, measuring instrument, lift appliance mounted to it and/or integrated with it; is provided by a space frame of, preferably straight, beams, e.g. having a rectangular and/or elongate shape, e.g. providing a, preferably flat, platform or plateau. This allows for e.g. more design flexibility.

A different definition of this feature is as follows: the pump system comprises a basic frame, e.g. shaped as a, preferably flat, platform or plateau that is, seen in top view, divided in at least two areas, the first area carries the one or more pumps and the second area carries one or more of the lift appliance, pump interface means vent valve arrangement and measuring instrument, wherein preferably the first area and second area each cover at least 25% of the surface area of the basic frame. Preferably one or more of the following applies: the protective frame, housing the one or more pumps, is part of and/or located in the first area and/or is not part of and/or not located in the second area; the first and second area are mutually divided by a straight line of separation; one or more of the basic frame, first and second area have a right angled, e.g. rectangular, shape in top view; the docking cone projects below the second area.

Hinged Lift Appliance

The lift appliance, preferably, is pivotable or hinged fastened to the pump system, preferably to the main frame, e.g. to the auxiliary support frame and/or at a location externally from and/or remote from the one or more fluid pumps and/or the protective frame, e.g. for a distance of at least 10 or 25 or 50 centimetre. One or more of the following applies: has a pivot shaft; is pivotable or hinged fastened and/or its pivot shaft is located at low level or at the lower side or bottom or in the lower half of the height measured from the under side to the top side of the protective frame of the pump system; can pivot between a horizontal and vertical position; comprises a rigid bracket that is hinged fastened to the pump system; comprises an e.g. U-shaped, rigid bracket having two legs, the two free ends of the two legs of it are hinged mounted to the pump system; the rigid bracket is hinged fastened to the pump system at two spaced locations at least 50 centimetre separated; the lift appliance, e.g. rigid bracket has a gantry like design; straddles the pump system interface means; is hinged fastened at opposite sides of the pump system interface means; covers in the horizontal position a delicate part, e.g. measuring instrument or display screen, of the pump system; is provided with the quick connector, e.g. padlock eye system, for releasable fastening to the bucket for which preferably the pivot shaft provides the pin of the padlock eye system and/or is designed axially retractable and is provided with a drive means, e.g. hydraulic cylinder, to axially retract and extend to obtain a completely retracted and a completely extended position; the one or more structural elements, e.g. plates, with hole of the padlock eye system are fastened to the rigid bracket; each leg of the rigid bracket is provided with at least one or two parallel structural elements, e.g. plates, with a hole of the padlock eye system; straight below the pivot shaft the pump system is provided with an opening to allow passage from below of the bucket quick connector, e.g. plate with hole of the padlock eye system; the pivot shaft is provided by two mutually aligned length parts having an axial spacing of at least 25 or 50 centimetre and/or each associated with a leg of the rigid bracket; the pivot shaft, e.g. at least one or each of the two mutually aligned length parts of the pivot shaft, is provided as retractable pin of the padlock eye system, provided with a drive means for retraction and extension; the pivot shaft or each pivot shaft length part is aligned with the associated holes of which one or two are provided in structural elements (16, 36) of the frame of the pump system and one or two are provided in structural elements (35) of the lift appliance; the pivot shaft or each length part penetrates if completely retracted the holes of only one of the two of both the lift appliance structural elements (35) and the pump system frame structural elements (16) and if completely extended at least said two holes, preferably three or four holes; the holes of the lift appliance are located between the holes of the pump system frame; the pivot shaft provides hoisting load transfer between a pump system frame structural element and a lift appliance structural element; the lift appliance, e.g. rigid bracket, has a symmetrical shape and/or has an attachment means, e.g. eye, for a hoisting member, e.g. hook of a hoisting device, e.g. crane; has a releasable lock means to temporary lock the hinged position, e.g. angle, of the lift appliance relative to the pump system frame; the releasable lock means has a drive means for locking and/or unlocking and/or a retractable member, e.g. lock pin; the releasable lock means, e.g. its retractable member, is located radially eccentrically from the pivot shaft and/or at a radial distance from the pivot shaft at least 10 centimetre; the releasable lock means has a part, e.g. pin, associated with the pump system frame and a part, e.g. hole, associated with the lift appliance, or vice versa, which parts can be temporary mutually engaged for locking and thus avoid pivoting of the lift appliance relative to the pump system frame; the lock pin is axially moved by the drive means to obtain a completely extended and a completely retracted position; the drive means is provided with a biasing spring to bias the lock means to the locking position. This allows for e.g. more design flexibility.

Level Indicator

A measuring instrument, e.g. level indicator (to indicate the verticality of the upright bucket), is provided at the main frame, e.g. at the auxiliary frame, at a location to be covered and/or overlaid or blocked for viewing by the hinged lift appliance if not in the upright position, e.g. in the parallel to the top plate position (i.e. horizontal position), and be exposed if in the upright position or not in the parallel to the top plate position. The measuring instrument is e.g. designed to be viewed from above by e.g. an ROV camera. If covered/overlaid/blocked, it is protected by the hinged lift appliance against damage from impact of a falling object.

The invention is further illustrated by way of non-limiting, presently preferred embodiments providing the best way of carrying out the invention and shown in the drawings.

BRIEF DESCRIPTION OF THE DRAWING

The following drawings further illustrate non-limiting, presently preferred embodiments.

DETAILED DESCRIPTION

FIG. 1-6 show known as such components of the pump system.

Figure 13:
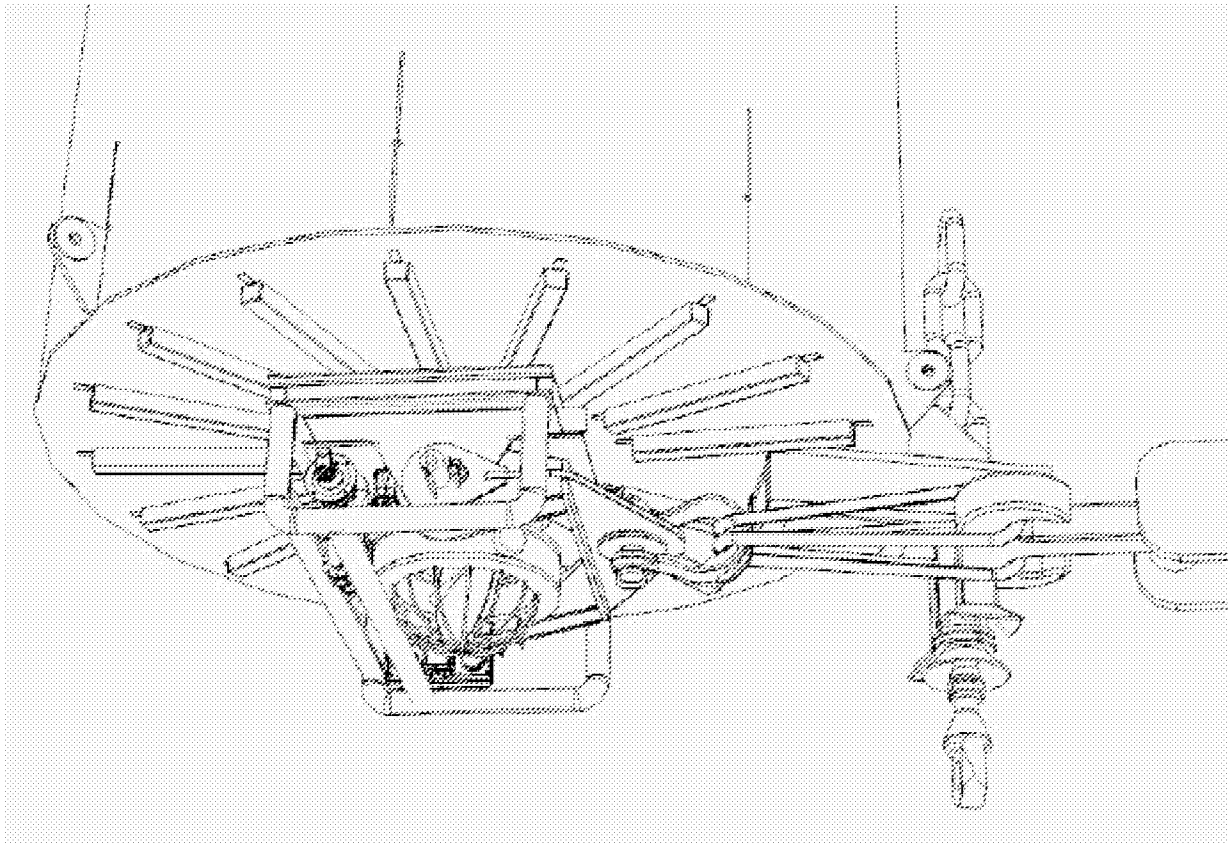
Figure 14:
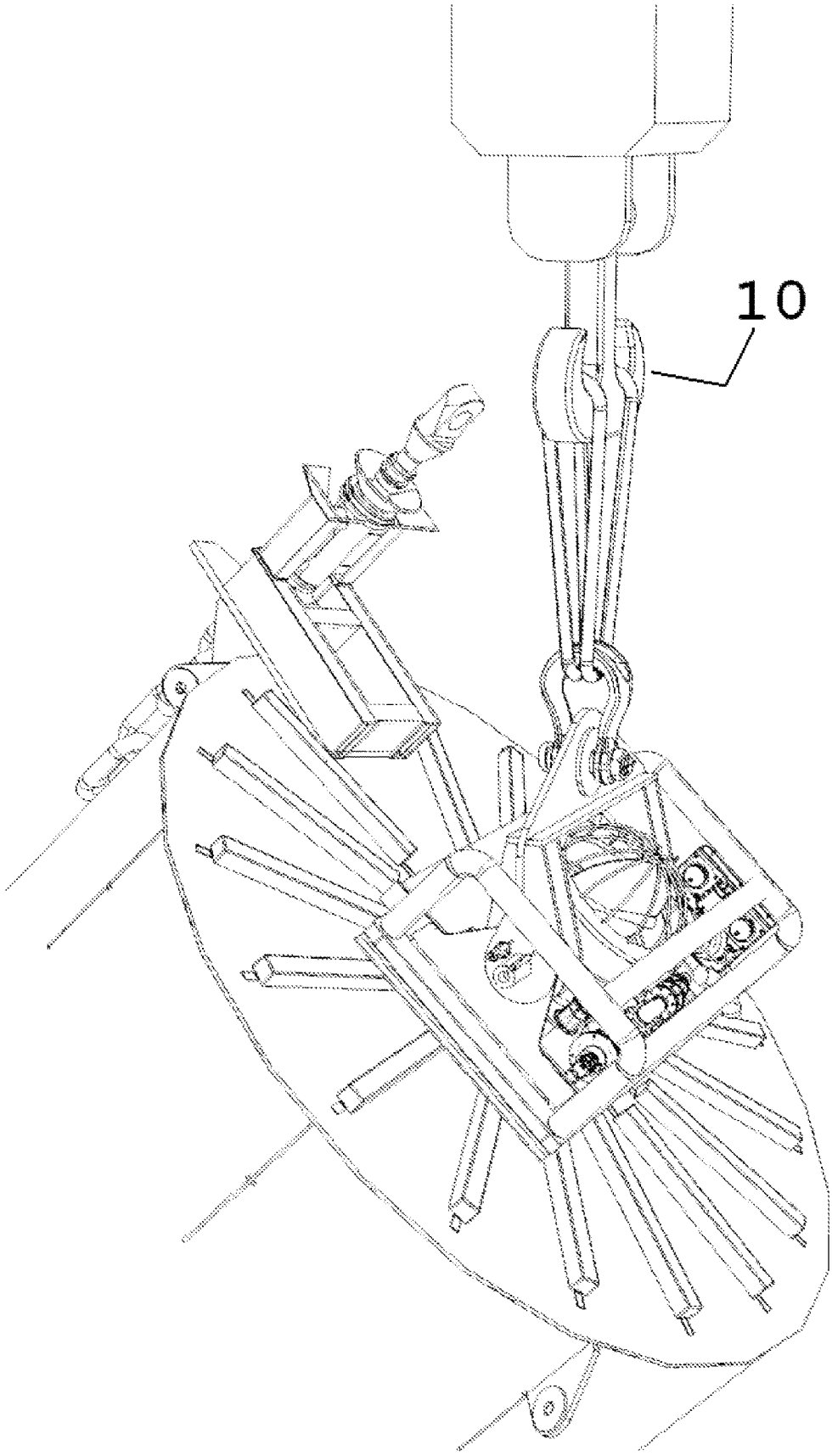
Figure 15:
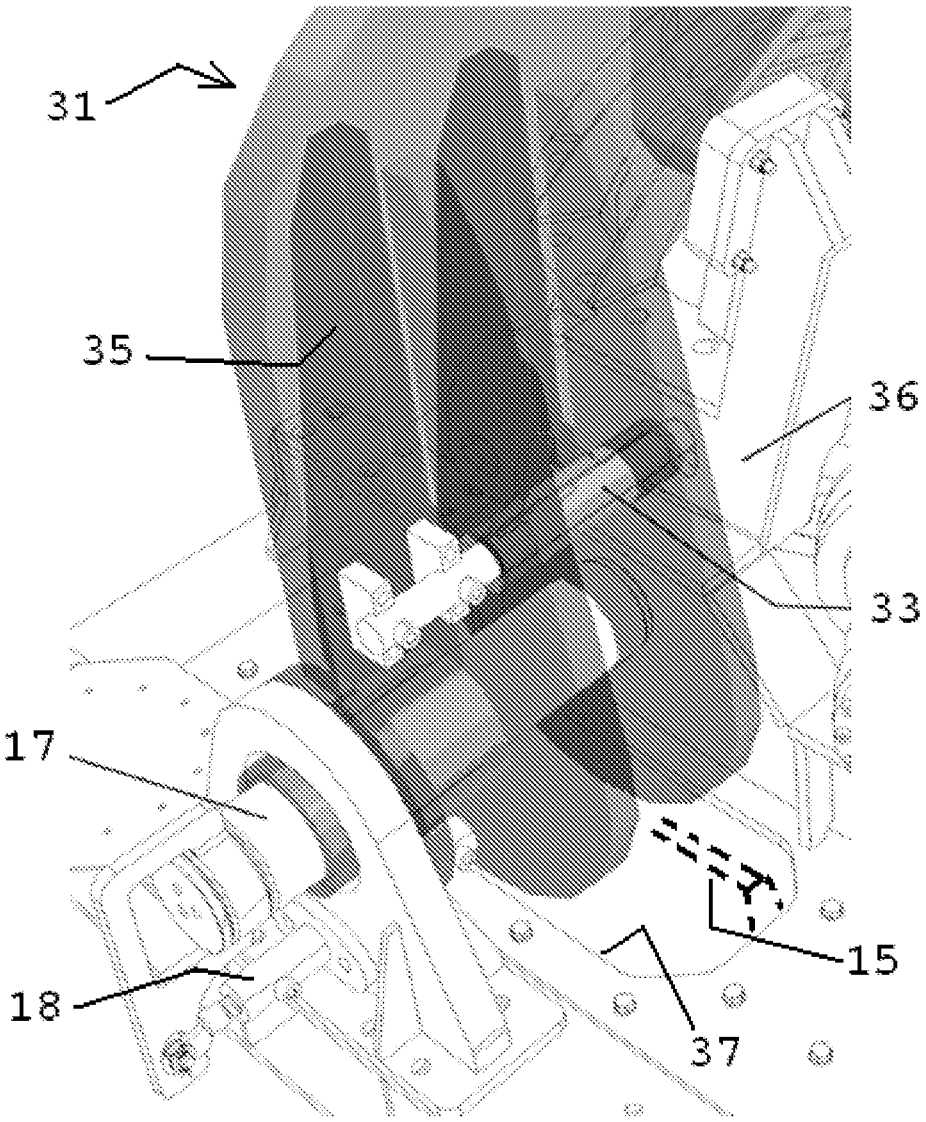
FIG. 15 shows a perspective of a detail of FIG. 7.

Except for FIG. 13-15, the pump system is shown in its operative position of the bucket is vertically upright positioned.

Figure 1:
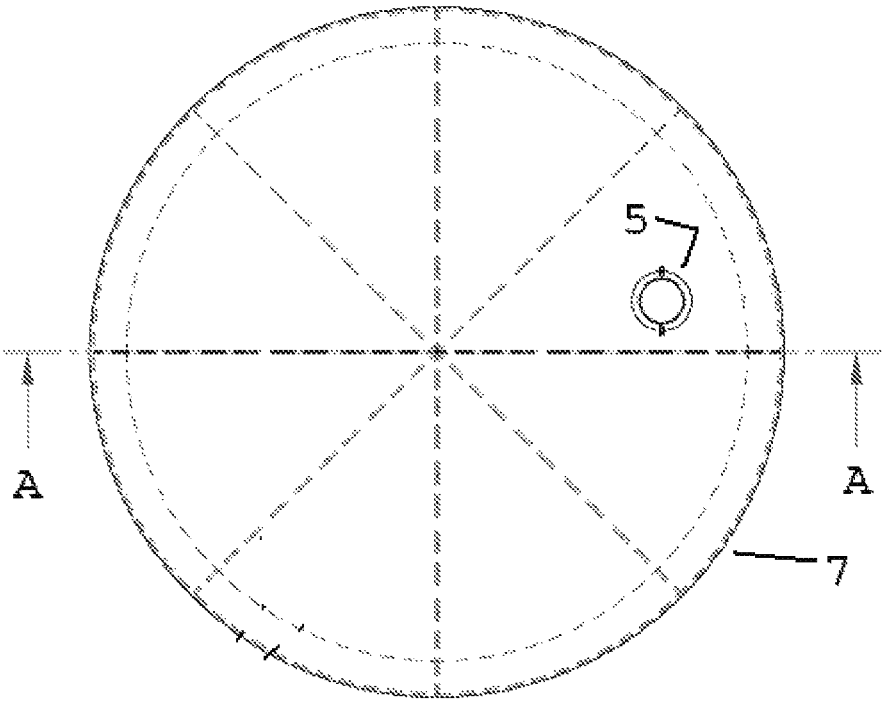
FIG. 1 shows a top view of a suction pile.
Figure 2:
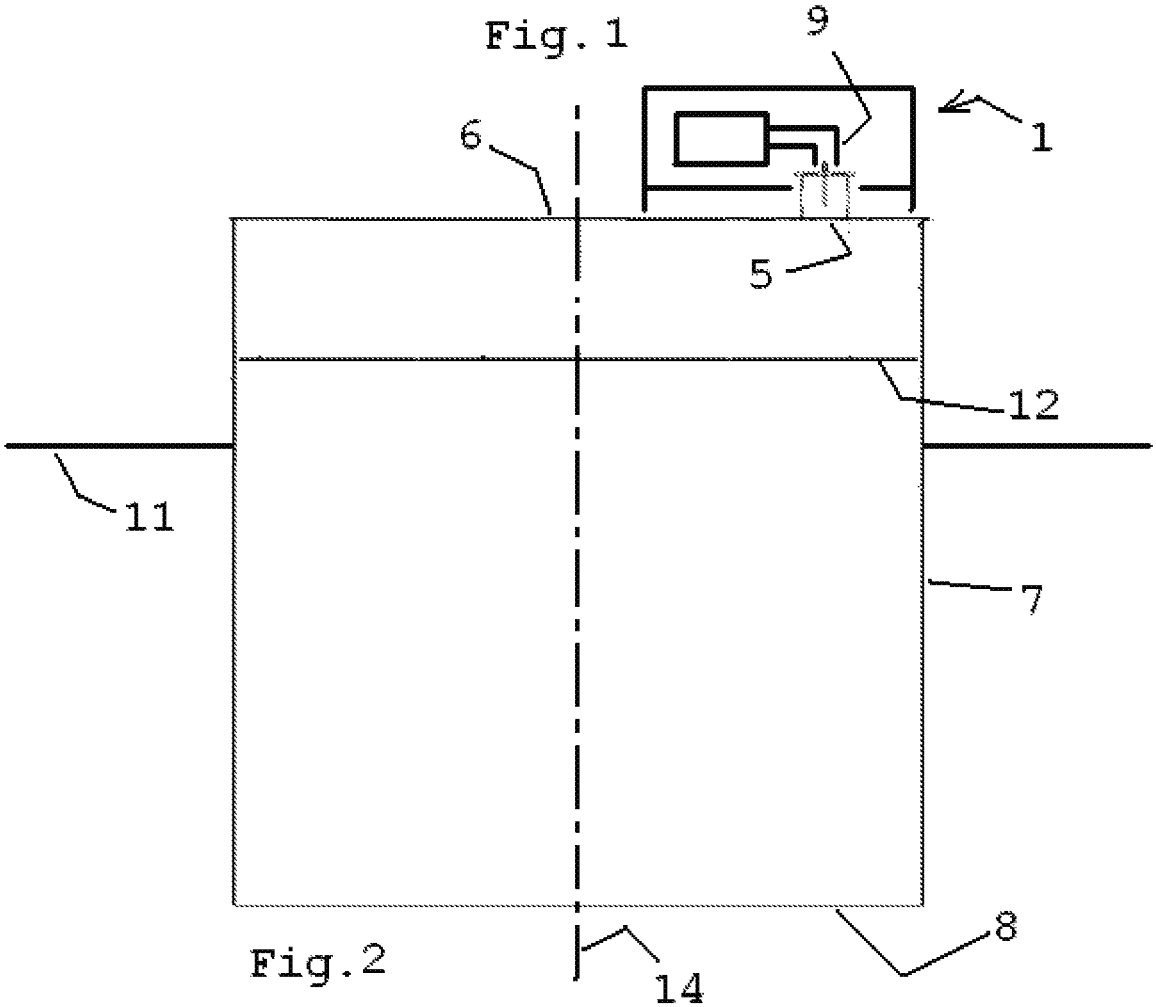
FIG. 2 shows a sectional side view according to the FIG. 1 line A-A of the suction pile and a pump system on top of it.

FIG. 1-2 show the suction pile interface means 5, the cylindrical wall 7, the pump system 1, the pump system interface means 9, the seafloor 11, the soil plug 12 within the suction space, the top bulkhead 6, the longitudinal axis 14, the open lower side 8.

Figure 3:
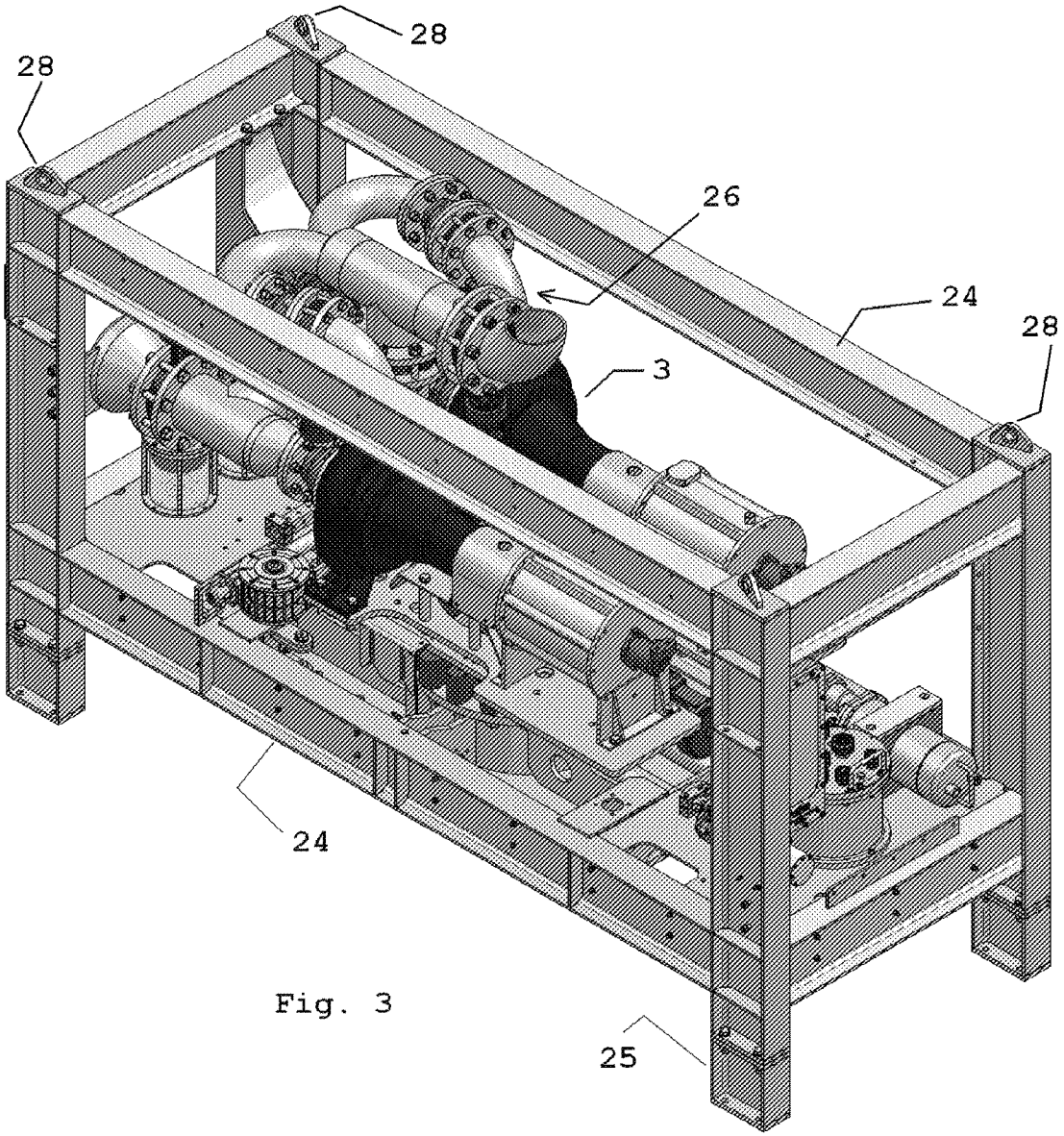
FIG. 3 shows a pump system in perspective view.
Figure 4:
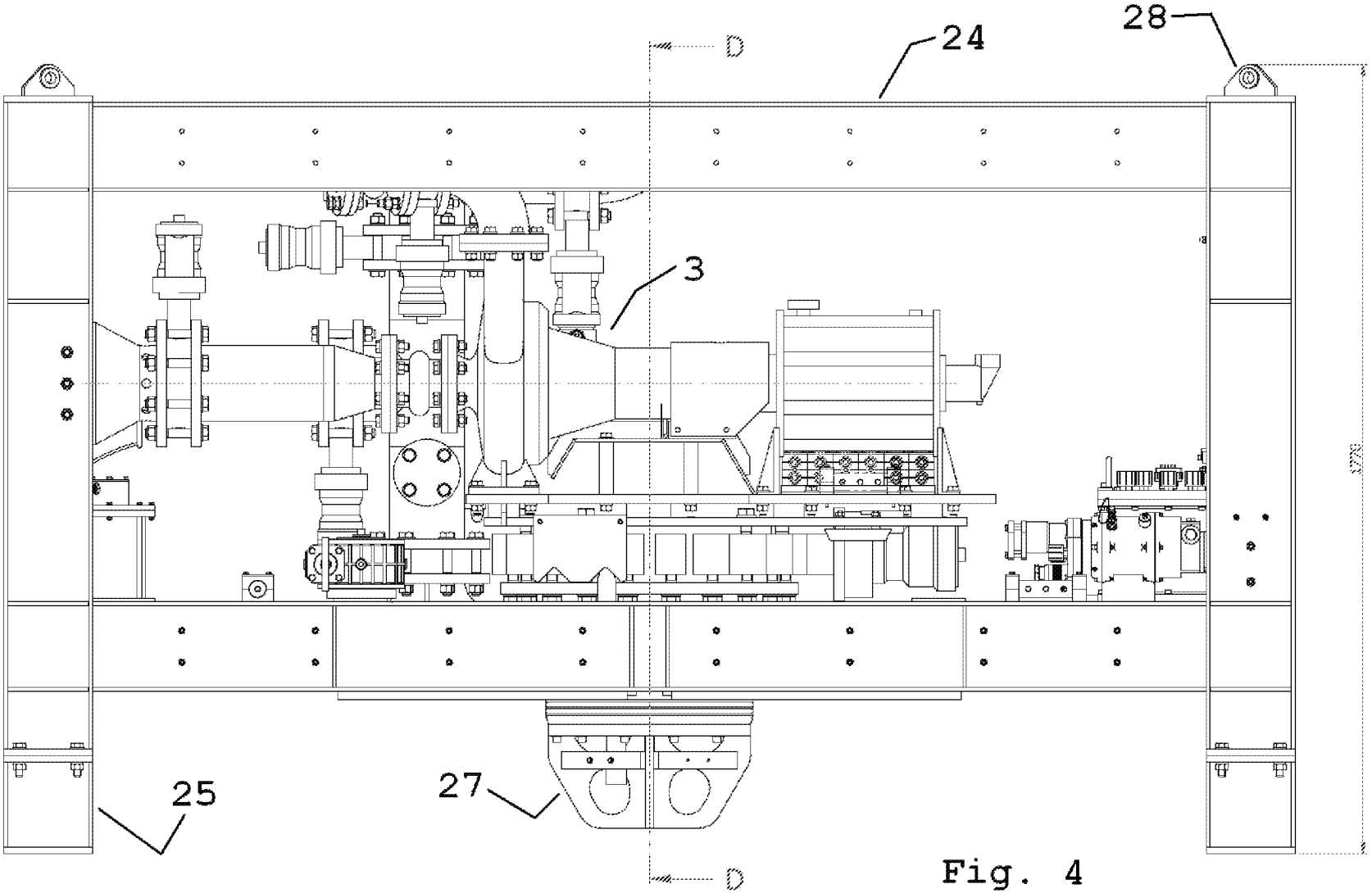
FIG. 4 shows a side view of the FIG. 3 system.
Figure 5:
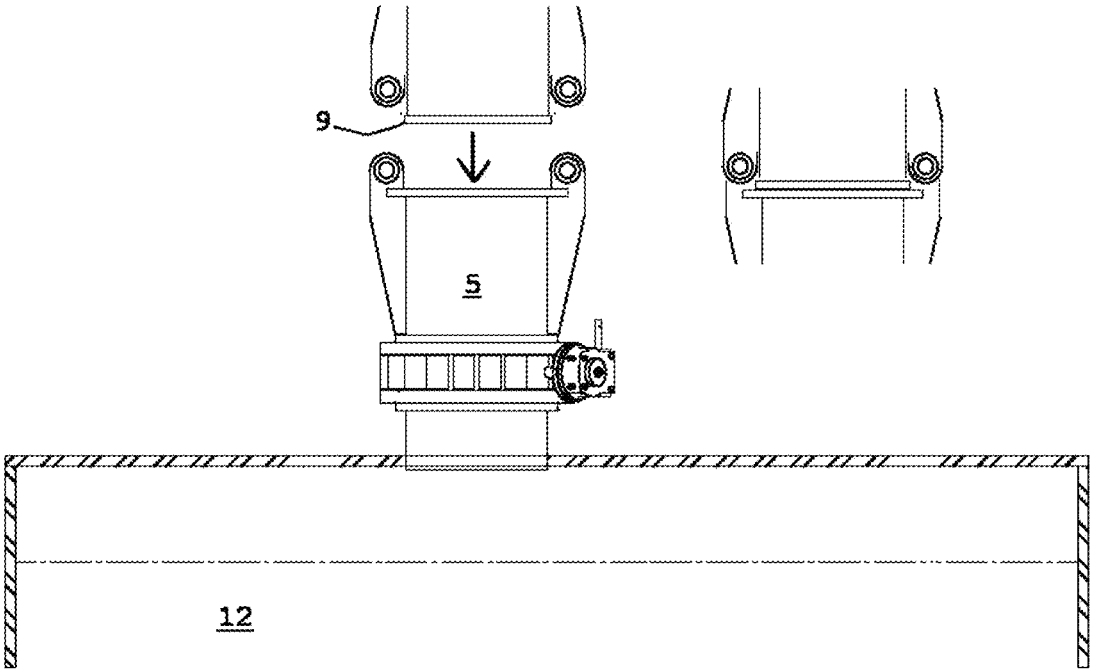
FIG. 5 shows an exploded side view of a pin locked flange coupling.

FIG. 3-5 show particulars of the pump system, particularly the above discussed features: a quick connector to mutually lock the pump system and suction pile interface means releasably; measurement probe design; docking cone design; piping for changing the water flow direction without reversing the pump; pin override system on latching pins; vent valve arrangement in pump system; compact pump system size dimensions.

FIG. 3 illustrates the protective external space frame 24 and the four supporting feet 25. At the top, the frame 24 is provided with attachments 28 (e.g. eyes) for a hoisting device to hoist the pump system 1 and also the suction pile suspending from the pump system when the interface means 5, 9 are mutually coupled. The pump 3 and its drive at opposite sides of the interface means 5, 9 are visible.

Figure 6:
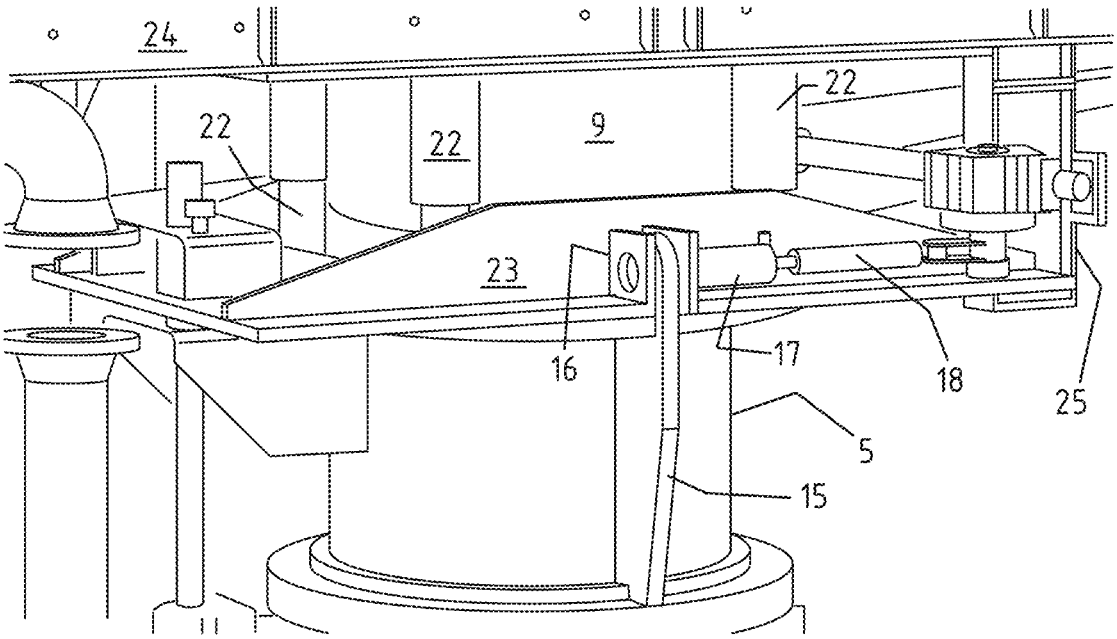
FIG. 6 shows a perspective view of an alternative to the FIG. 5.

FIG. 6 shows the protective element at a distance above the pump system interface means, as part of the vent valve arrangement. The cone 27 is the lower part (FIGS. 4 and 6).

FIG. 5 shows to the right hand side the locked state. This embodiment can be designed such that the complete suction pile can suspend from the mutually locked interface means 5, 9, in different words the suction pile can suspend from the protective frame. The arrow illustrates the displacement of the pump system interface means 9 towards the suction pile interface means 5.

FIG. 6 shows of the padlock eye system the two parallel plates 16 associated with the pump system interface means, and the pin 17 to mutually lock the registered holes of the three plates 15, 16. The plate 15 being part of the padlock eye system and sandwiched between the plates of the pump system interface means if the interface means are mutually locked. Also shown is the hydraulic jack 18 as the actuator to retract and extend the pin 17.

FIG. 6 shows an embodiment for rigid coupling of the pump system 1 to the top bulkhead 6 while simultaneously it is allowed that the pipes 5 and 9 are selectively mutually spaced (e.g. for purposes of venting fluid from inside the suction pile to the environment) or mutually connected. A connector frame 23 is provided with the plates 16 of the padlock eye system. The connector frame 23 is attached to the protective frame 24 by four hydraulic jacks 22 (three visible in FIG. 6) regularly spaced around the interface means 9. At the time the plates 15 and 16 are mutually fixed by the pins 17, the distance between the pipes 5 and 9 can be adapted by operating the hydraulic jacks to extend or retract.

The FIG. 6 embodiment allows to suspend the suction pile from the protective frame 24.

FIG. 7-15 show how the hinge of the hinged lift appliance is located aside from the protective frame enveloping the pump system.

Figure 7:
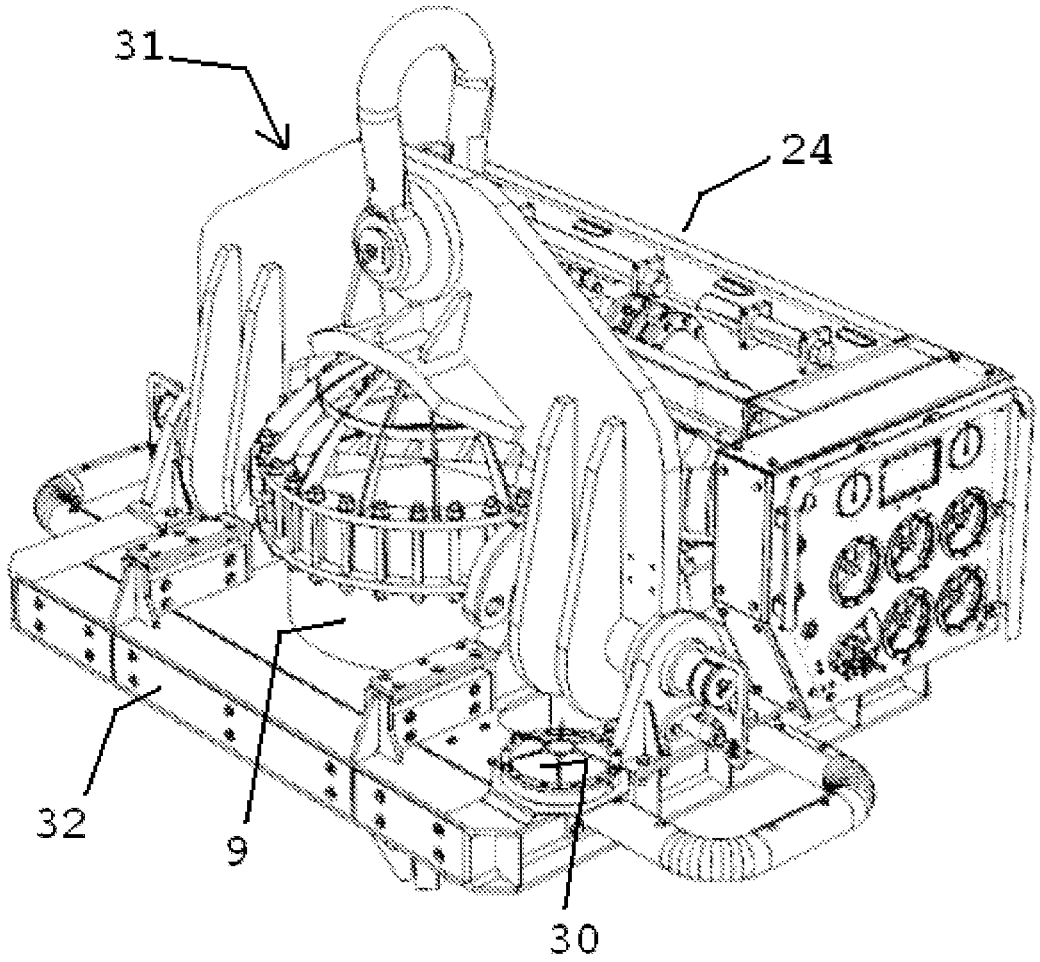
FIG. 7 shows a perspective of the inventive pump system.
Figure 8:
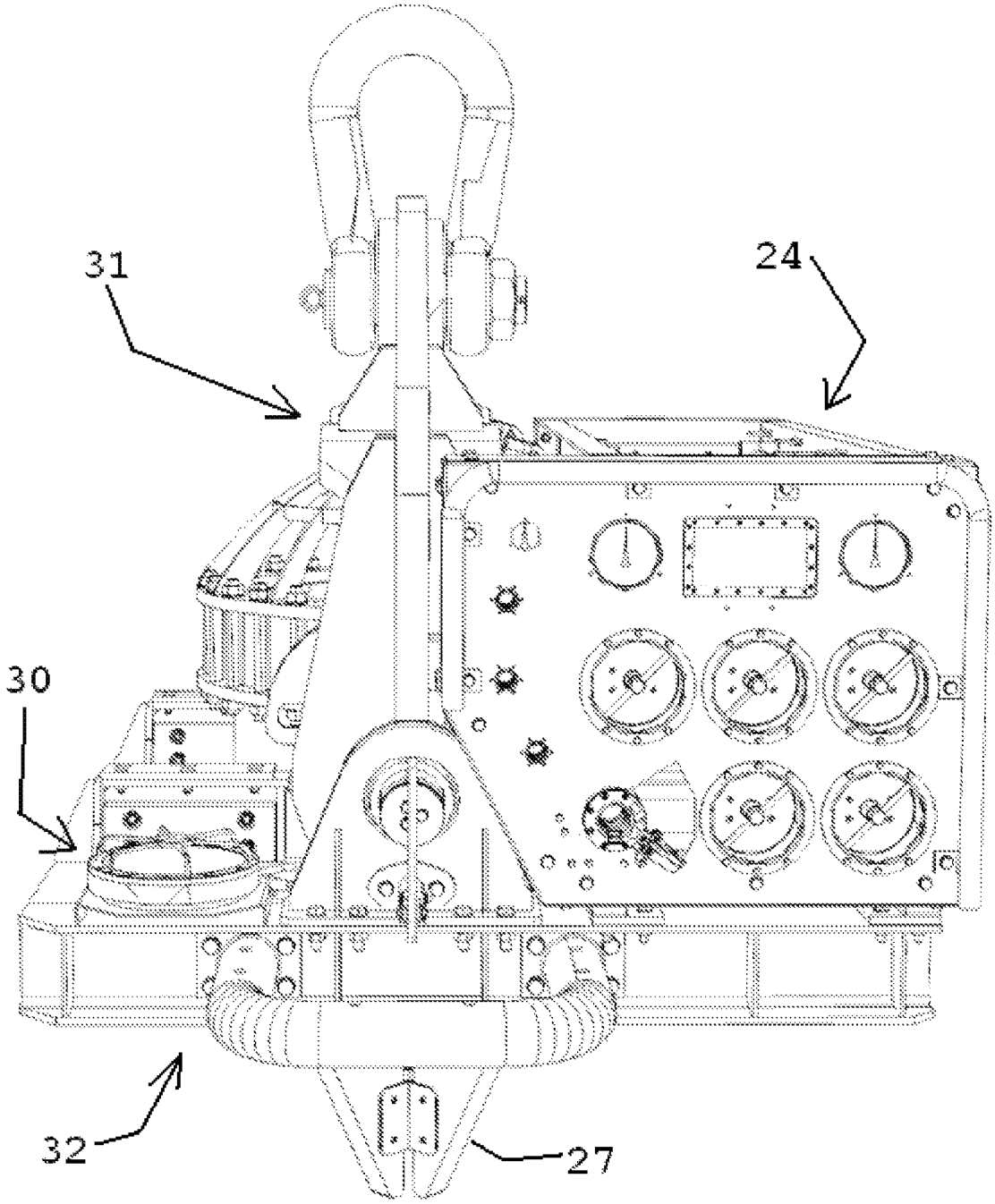
FIG. 8 shows an end view of the system of FIG. 7.

FIG. 8 illustrates the location of the level indicator 30, exposed since the hinged lift appliance 31 is in the upright position. FIGS. 7 and 8 show the control panel (in FIG. 8 shown at the right hand side of the lift appliance 31 and in front of the protective frame 24).

Figure 11:
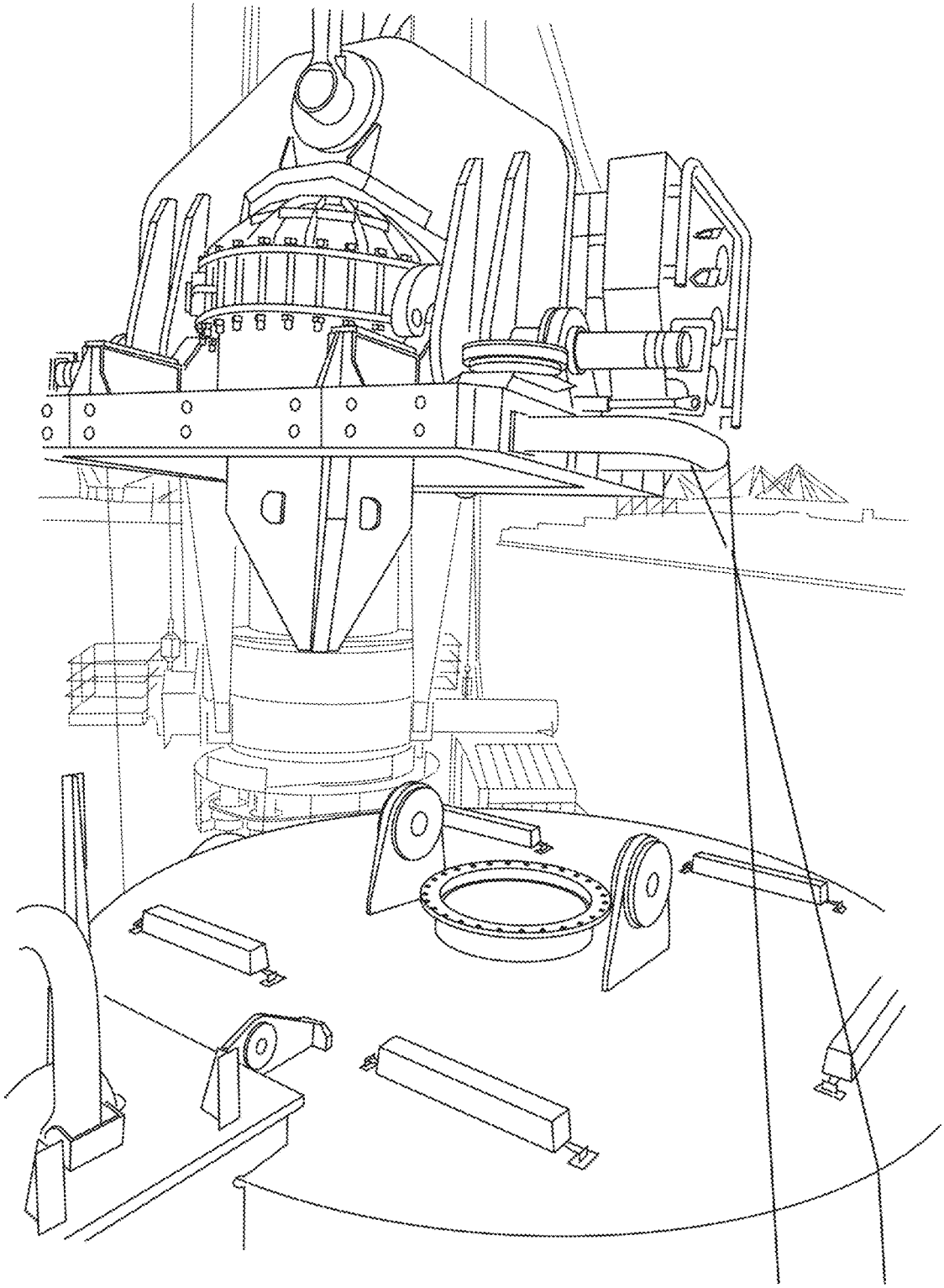
Figure 12:
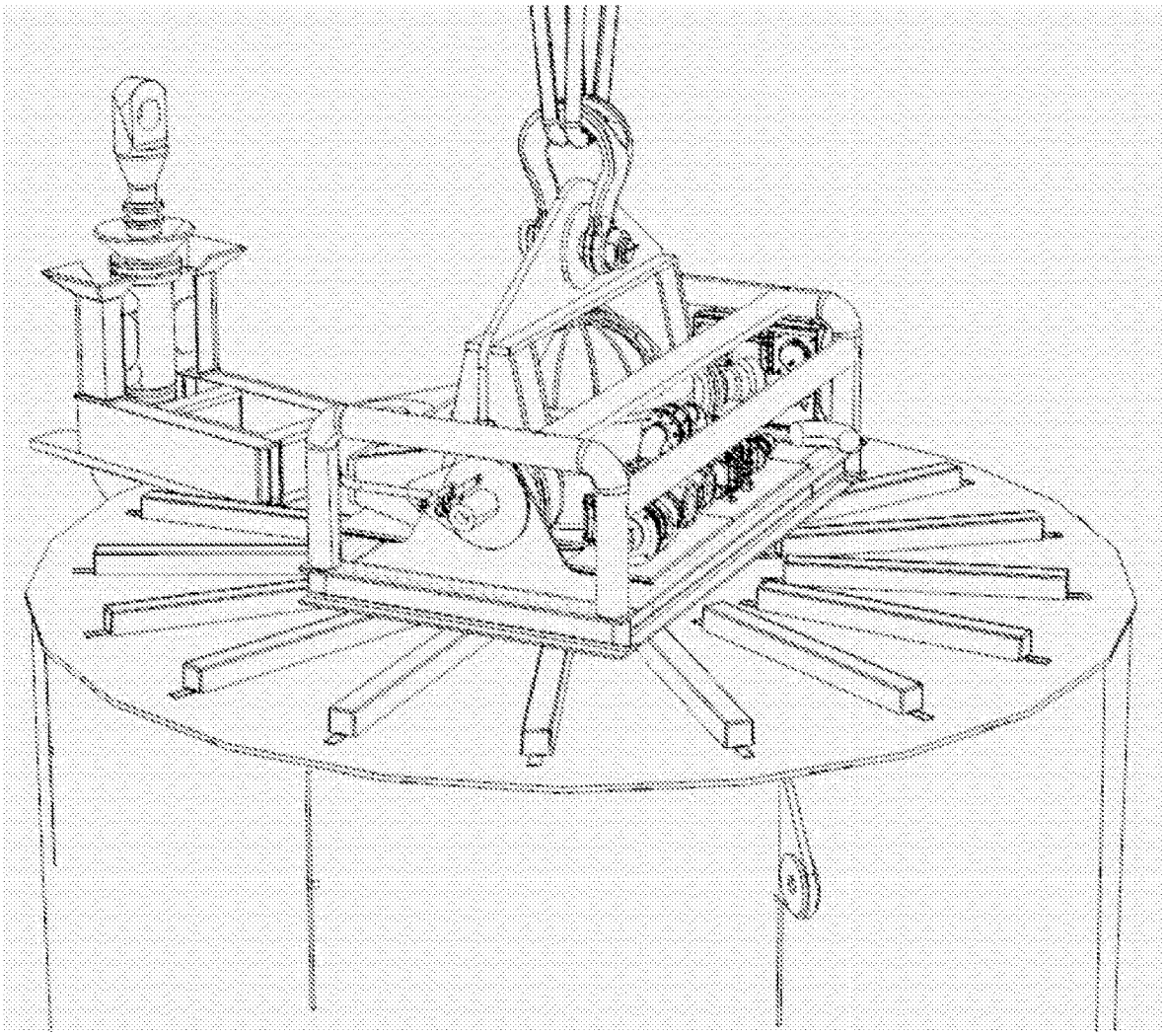
FIG. 12, FIG. 13, and FIG. 14 show perspectives of the system of FIG. 7.

FIG. 11 shows the cone 27 of the pump system in register closely above the suction pile interface means 5, the hinged lift appliance 31 suspended from a crane hook 10.

Figure 16:
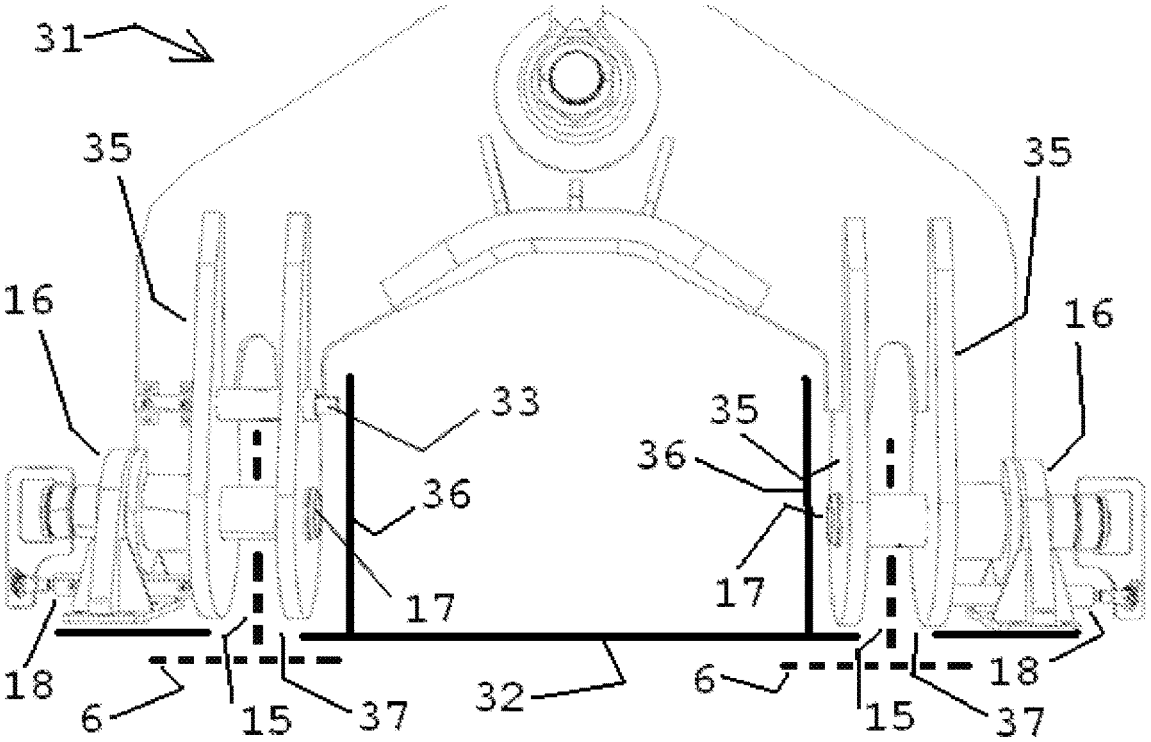
FIG. 16 shows a front view of a part of FIG. 7.

FIGS. 15 and 16 show of the padlock eye system the plates 16 permanently fixed to the pump system. The plate 15 permanently fixed to the top bulkhead 6 of the bucket is inserted from below between the lift plates 35 of the hinged lifting bracket 31. Pin 17 (i.e. the pivot shaft of the lift appliance 31) penetrates the registered holes of the plates 15 and 35. Also shown is a retractable lock pin 33 to temporary lock the hinged lifting bracket 31 in a fixed angular position relative to the frame 24. If extended (as shown in FIG. 15) the lock pin 33 penetrates a lock hole in bracket 36 that is rigid with auxiliary support frame 32.

FIG. 15 shows an opening 37 in auxiliary support frame 32. The plate 15 (imaginary shown) at the top bulkhead 6 is inserted from below through this opening 37 to project between the lift plates 35, to unite the bucket with the pump system 1.

If completely extended, the pin 17 penetrates holes in the plate 16, the two plates 35, the bracket 36 and possibly the plate 15 (only if the pump system is fastened to a bucket). If completely retracted, the pin 17 penetrates holes in the plate 16 and the plate 35 closest to plate 16, only.

Figure 9:
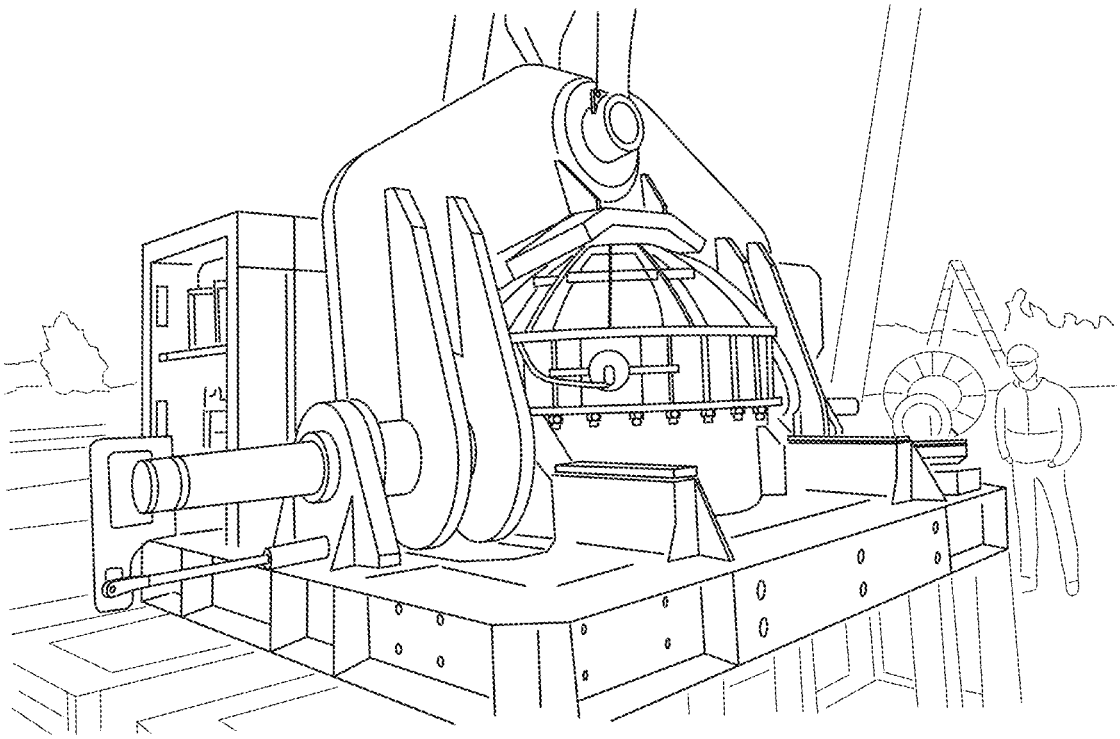
FIG. 9, FIG. 10, and FIG. 11 show pictures of the system of FIG. 7.
Figure 10:
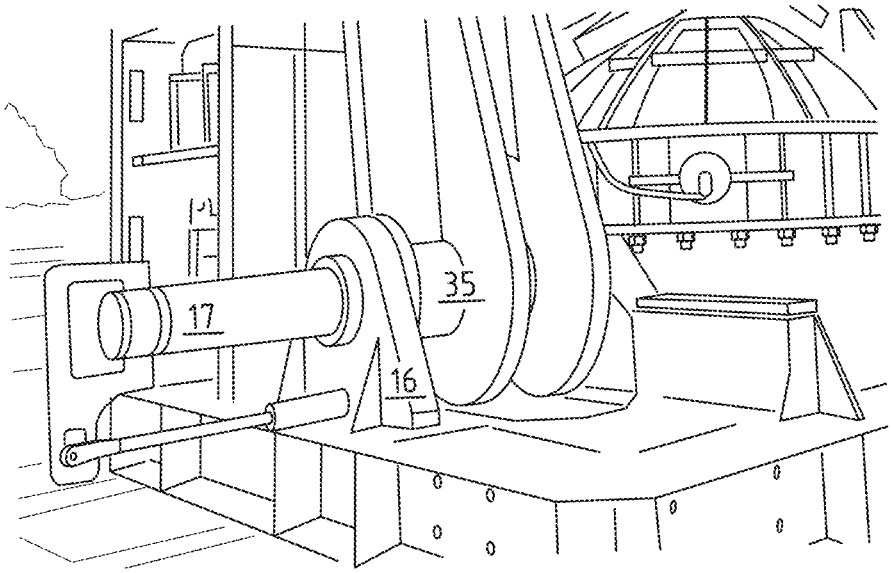

FIG. 9-11 show pin 17 retracted such that plate 15 can freely move in and out the space between the lift plates 35. FIG. 15-16 show pin 17 extended and thus penetrates the hole in plate 15 and bracket 36, if the pump system 1 is properly located on top of the top bulkhead 6.

Figure 17:
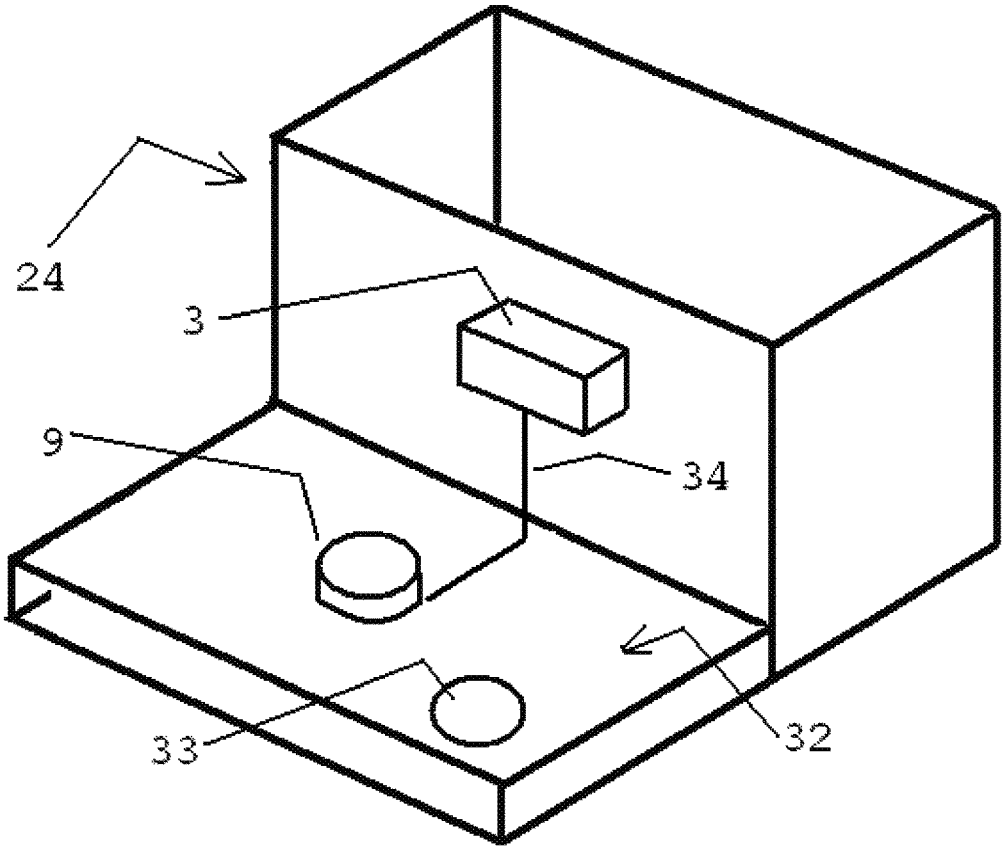
FIG. 17 shows a schematic perspective view of an alternative inventive pump system.

FIG. 17 shows the pump interface means 9 aside from the protective frame 24 of the pump 3, the pump interface means 9 carried by an auxiliary support frame 32 projecting sideways from and integral with the bottom or lower part of protective frame 24, and the location of the level indicator 30 and of a liquid line 34 between pump 3 and pump interface means 9.

The embodiments are not limited to the above described and in the drawings illustrated embodiments. E.g. the marine structure can have a different number of suction buckets. The drawings, the specification and claims contain many features in combination. The skilled person will consider these also individually and combine them to further embodiments. Features of disclosed embodiments can, in different manners, be combined and different aspects of some features are regarded mutually exchangeable. All features described or shown in the drawing provide as such or in arbitrary combination the subject matter of the description, also independent from their arrangement in the claims or their referral.

The invention claimed is:

1. An assembly comprising:

a suction pile;

a rigid supporting frame or platform removably connectable to the suction pile;

a pump system, wherein:

the pump system is connected to the rigid supporting frame or platform and comprises a pump, the pump system is configured to be temporarily connected to a suction space of the suction pile, and the suction pile comprises a top bulkhead and one or more plates extending upward from and rigid with the top bulkhead or permanently fixed at the top bulkhead; and a lifting appliance, wherein:

the lifting appliance is configured to be hingedly or pivotably connected to the rigid supporting frame or platform and to lift or move the pump system and the rigid supporting frame or platform away from the suction pile, the lifting appliance is further configured to be hingedly or pivotably connected to both the one or more plates of the suction pile and structural elements of the rigid supporting frame or platform and to lift or move the pump system and the rigid supporting frame or platform with the suction pile, the rigid supporting frame or platform comprises one or more openings configured to be penetrated from below by at least one of the one or more plates extending upward from and permanently fixed at the top bulkhead, the structural elements comprise plates formed with the rigid supporting frame or platform, the plates of the structural elements comprise first holes, the one or more plates of the suction pile comprise second holes, and the lifting appliance is further configured to penetrate the first and second holes to hingedly or pivotably connect both the suction pile and the rigid supporting frame or platform with the pump system to the lifting appliance.

2. The assembly according to claim 1, wherein the lifting appliance is designed to pivot, relative to the rigid supporting frame or platform from an upright position, perpendicular to the top bulkhead of the suction pile, into a downward position making an angle of at least 45 or 60 degrees, with the upright position.

3. The assembly according to claim 2, wherein the lifting appliance has, in sideview, an upside-down U-shape.

4. The assembly according to claim 3, wherein the lifting appliance comprises a lifting grip configured to engage a hoist.

5. The assembly according to claim 1, further comprising:

a retractable locking pin to temporarily disable, if engaged by selective operation, a pivoting movement of the lifting appliance such that the lifting appliance keeps a fixed orientation or angular attitude relative to parts of the pump system relative to which the lifting appliance is designed to pivot if the retractable locking pin is disengaged by selective operation.

6. The assembly according to claim 1, wherein the pump system comprises a docking cone arranged to penetrate a suction pile interface comprising an upward directed pipe at the suction pile when the suction pile interface is interlocked with a pump interface of the pump system.

7. The assembly according to claim 6, wherein distal ends of lift plates of the lifting appliance are located at diametrically opposite sides of the docking cone.

8. The assembly as claimed in claim 1, wherein the pump of the pump system and the lifting appliance are located side by side on top of the rigid supporting frame or platform.

9. The assembly as claimed in claim 1, wherein the pump system comprises a pump interface permanently mounted to the rigid supporting frame or platform and located aside from the pump.

10. The assembly as claimed in claim 9, wherein the pump interface is located at at least one of a distance of at least 25 cm or 50 cm from the pump, or at a lower side or bottom of the pump of the pump system.

11. The assembly according to claim 1, wherein the pump system comprises a protective rigid frame enveloping at least the pump, a pump drive, and piping.

12. The assembly as claimed in claim 11, wherein:

the rigid supporting frame or platform is configured to project sideways from the protective rigid frame, and the rigid supporting frame or platform is at least one of integrated with, integral with, or rigid with the protective rigid frame.

13. The assembly as claimed in claim 12, wherein the rigid supporting frame or platform is at least one of integrated with, integral with, or rigid with the protective rigid frame with a bottom or lower part of the protective rigid frame.

14. The assembly as claimed in claim 1, wherein the rigid supporting frame or platform and the pump system bear onto the top bulkhead of the suction pile when the suction pile is extending upwardly.

15. The assembly as claimed in claim 1, wherein the rigid supporting frame or platform comprises a first area carrying the pump and a second area, different from the first area, carrying one or more of the lifting appliance and a pump interface configured to interlock with a suction pile interface comprising an upward directed pipe at the suction pile.

16. The assembly as claimed in claim 4, wherein lifting plates of the lifting appliance have at their distal ends a pivoting connection provided by a pin between the suction pile and the pump system.

17. The assembly according to claim 16, wherein the lifting grip is provided at a bridging part of the U-shape of the lifting appliance.

18. The assembly according to claim 17, wherein at least one of the lifting grip or the bridging part is configured to project above the pump system.

19. The assembly as claimed in claim 5, further comprising:

a hydraulic cylinder to axially retract and extend the retractable locking pin.

20. The assembly as claimed in claim 1, wherein:

the lifting appliance comprises a hinged lifting bracket comprising lift plates each comprising a hole, and the one or more plates are configured to be inserted through an opening in the rigid supporting frame or platform to a position between the lift plates of the hinged lifting bracket and to allow a pin to penetrate the respective hole of the one or more plates and the holes of the lift plates.

21. The assembly as claimed in claim 7, wherein the lifting appliance in its upward pivoted position is located vertically above the docking cone.

22. The assembly according to claim 21, wherein the docking cone is at least one of:

located sideways remote from a protective frame of the pump system; or supported by the rigid supporting frame.

23. The assembly according to claim 1, wherein a pin further forms a pivot shaft of the lifting appliance.

24. The assembly according to claim 1, wherein the pump system further comprises a level indicator.

25. The assembly according to claim 1, wherein:

the pump system further comprises a control panel, and the control panel comprises one or more of the following: a mechanical switch, a mechanical lever, a gauge, or an electronic display screen.

26. The assembly according to claim 25, wherein:

one or more of the mechanical switch or the mechanical lever is operable by a robotic arm on a remotely operated submersed vehicle, and one or more of the gauge or the electronic display screen is configured to be monitored by a camera of the remotely operated submersed vehicle.

* * * * *